US007063032B2

(12) United States Patent
Lindblade et al.

(10) Patent No.: US 7,063,032 B2
(45) Date of Patent: Jun. 20, 2006

(54) UPPER BEARING SUPPORT ASSEMBLY FOR INTERNAL TURRET

(75) Inventors: Stephen P. Lindblade, Waller, TX (US); Quoc A. Dang, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 10/831,611

(22) Filed: Apr. 23, 2004

(65) Prior Publication Data

US 2004/0261683 A1 Dec. 30, 2004

Related U.S. Application Data

(60) Provisional application No. 60/465,092, filed on Apr. 23, 2003.

(51) Int. Cl.
*B63B 21/00* (2006.01)

(52) U.S. Cl. ..... 114/230.12

(58) Field of Classification Search ..... 114/230.1, 114/230.12; 441/3, 4, 5
See application file for complete search history.

(56) References Cited

U.S. PATENT DOCUMENTS

| | | | |
|---|---|---|---|
| 3,279,404 | A | 10/1966 | Richardson |
| 4,606,727 | A | 8/1986 | Koenig et al. |
| 4,753,553 | A | 6/1988 | Carlsen et al. |
| 4,841,895 | A | 6/1989 | Brewerton |
| 5,052,322 | A | 10/1991 | Poldervaart et al. |
| 5,065,689 | A | 11/1991 | Krogstad |
| 5,266,061 | A | 11/1993 | Poldervaart et al. |
| 5,359,957 | A | 11/1994 | Askestad |
| 5,363,789 | A | 11/1994 | Laurie et al. |
| 5,381,750 | A | 1/1995 | Pollack |
| 5,515,804 | A | 5/1996 | Pollack |
| 5,517,937 | A | 5/1996 | Lunde |
| 5,746,148 | A | 5/1998 | Delago |
| 5,762,017 | A | 6/1998 | Groves |
| 5,782,197 | A | 7/1998 | Pollack |
| 5,839,387 | A | 11/1998 | Myklebust |
| 5,850,800 | A | 12/1998 | Commandeur |
| 5,860,382 | A | 1/1999 | Hobdy |
| 5,913,279 | A | 6/1999 | Braud et al. |
| 5,957,076 | A | 9/1999 | Pollack et al. |
| 6,164,233 | A | 12/2000 | Pollack et al. |
| 6,269,762 | B1 | 8/2001 | Commandeur |
| 6,502,524 | B1 | 1/2003 | Hooper |
| 6,588,357 | B1 | 7/2003 | Hobdy |

(Continued)

FOREIGN PATENT DOCUMENTS

| | | |
|---|---|---|
| FR | 2 770 484 A1 | 5/1999 |

(Continued)

*Primary Examiner*—Stephen Avila
(74) *Attorney, Agent, or Firm*—Henry C. Query, Jr.

(57) ABSTRACT

A turret mooring system for a vessel which includes a moon pool comprises a turret which is positioned in the moon pool, a buoy and anchor chain assembly for anchoring the turret to the sea floor, a bearing assembly for rotatably connecting the turret to the vessel, and a bearing support assembly which comprises an upper ring member to which the bearing assembly is connected, a lower ring member which is connected to the vessel in the moon pool, and a number of elongated support beams which are connected between the upper and lower ring members. In addition, the lower ring member is connected to the vessel near the vertical center of the vessel in order to minimize the deflections of the bearing assembly due to hogging and sagging of the vessel.

34 Claims, 2 Drawing Sheets

U.S. PATENT DOCUMENTS

2003/0121465 A1* 7/2003 Boatman et al. ..... 114/230.12
2003/0154899 A1* 8/2003 Cottrell et al. ..... 114/230.12

FOREIGN PATENT DOCUMENTS

WO WO 01/25080 A1 4/2001

* cited by examiner

UPPER BEARING SUPPORT ASSEMBLY FOR INTERNAL TURRET

This application is based on U.S. Provisional Patent Application No. 60/465,092, which was filed on Apr. 23, 2003.

BACKGROUND OF THE INVENTION

The present invention is directed to a turret mooring system which comprises a turret that is rotatably supported in the moon pool of a vessel by at least an upper bearing assembly. More particularly, the invention is directed to a bearing support assembly which isolates the upper bearing assembly from deflections of the vessel.

Turret mooring systems are commonly used to anchor a vessel to the sea floor. Internal turret mooring systems typically comprise a turret which is rotatably supported in a moon pool that is formed in the hull of the vessel between the bow and the stern. The turret is often supported by both an upper bearing assembly which is connected between the upper end of the turret and the top of the moon pool and a lower bearing assembly which is connected between the lower end of the turret and the bottom of the moon pool. The upper bearing assembly typically comprises a combination axial and radial bearing which is capable of transmitting both the vertical and horizontal mooring loads from the turret to the vessel. The lower bearing assembly usually comprises a radial bearing which transmits only the horizontal mooring loads from the turret to the vessel.

A vessel in the open sea is often affected by waves and swells which can cause the vessel to hog and sag. As the vessel hogs and sags, the normally circular cross section of the moon pool deflects into alternating oval configurations. Since the vessel reacts somewhat like a beam in bending, these deflections are greatest at the top of the moon pool, which is normally where the upper bearing assembly is connected. In addition, turret mooring systems are typically designed to provide a clearance between the lower bearing assembly and the turret. As a result, the horizontal mooring loads will cause the turret to pivot about a horizontal axis located near the upper bearing assembly. Unless means are provided to isolate the upper bearing assembly from the deflections of the moon pool and the pivoting of the turret, these displacements may damage the upper bearing assembly and interfere with the operation of the turret mooring system.

In certain prior art turret mooring systems, bearing support assemblies comprising elastomeric or steel springs have been employed to isolate the upper bearing assembly from the deflections of the moon pool and to allow the turret to pivot about a horizontal axis. However, these bearing support assemblies contain many parts, require frequent maintenance and are expensive.

SUMMARY OF THE INVENTION

In accordance with the present invention, these and other disadvantages in the prior art are overcome by providing a bearing support assembly for a turret mooring system which comprises a turret that is rotatably supported in a moon pool of a vessel by an upper bearing assembly which is secured to an upper portion of the turret. The bearing support assembly comprises an upper ring which is connected to the upper bearing assembly, a lower ring which is connected to the moon pool, and a number of support beams which extend between the upper and lower rings. Furthermore, the lower ring is located near the vertical center of the moon pool where the deflections due to hogging and sagging of the vessel are minimal. In addition, the support beams are preferably designed to deflect slightly and thereby allow the turret to pivot about a horizontal axis located near the upper bearing assembly.

Since the lower ring of the upper bearing support assembly is located near the vertical center of the vessel, only minimal deflections of the vessel will be transmitted to the upper bearing assembly through the support beams. In addition, because the support beams will deflect and allow the turret to pivot, the pivoting of the turret will not adversely affect the upper bearing assembly. Thus, the upper bearing support assembly of the present invention provides an effective means to isolate the upper bearing assembly from both the deflections of the vessel and the pivoting of the turret.

These and other objects and advantages of the present invention will be made apparent from the following detailed description, with reference to the accompanying drawings.

DETAILED DESCRIPTION OF THE PREFERRED EMBODIMENTS

Figure 1:
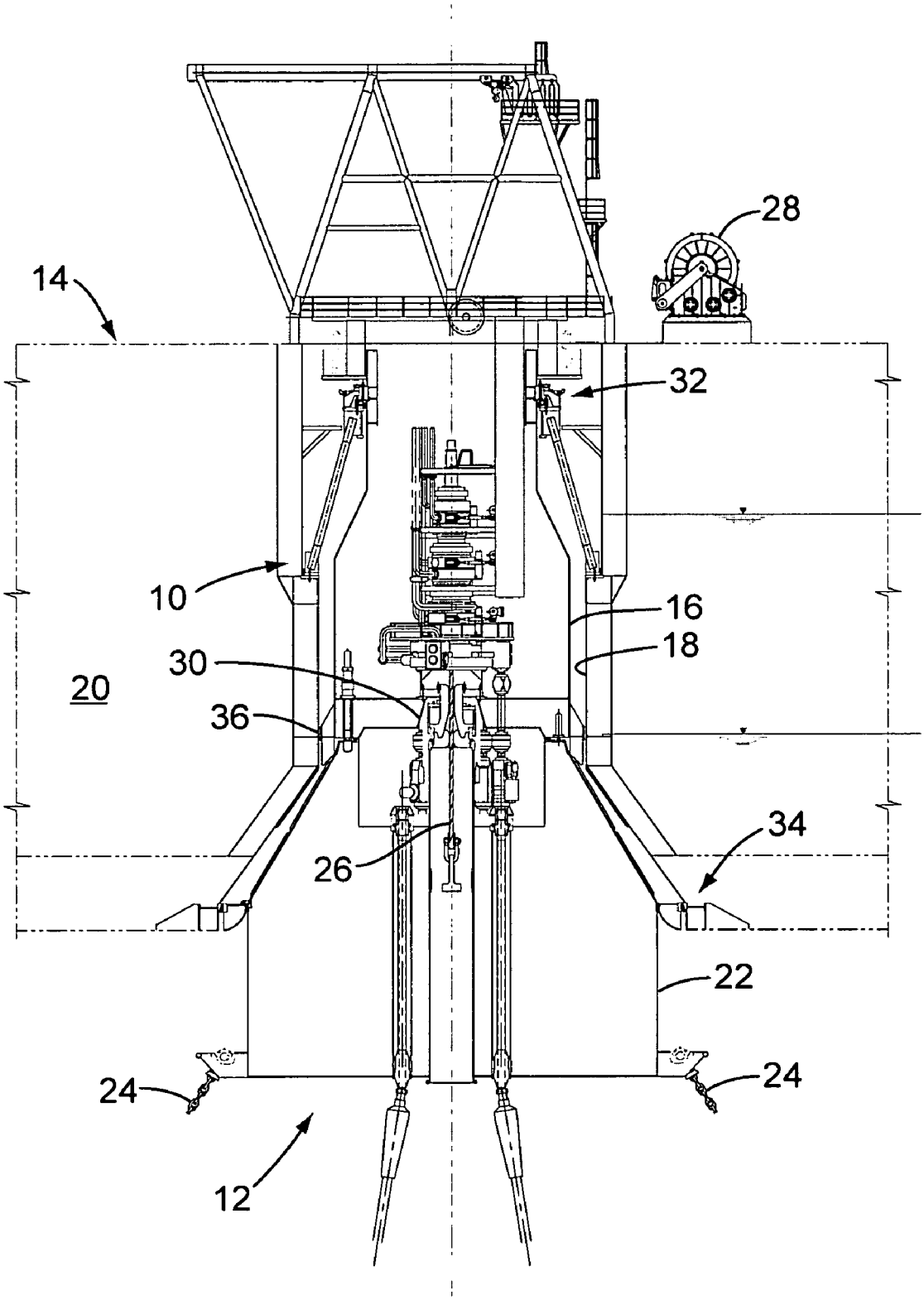
FIG. 1 is a cross sectional view of a turret mooring system which comprises the upper bearing support assembly of the present invention.

Referring to FIG. 1, the upper bearing support assembly of the present invention, which is indicated generally by reference number 10, is shown installed in an exemplary turret mooring system 12 for a vessel 14. The turret mooring system 12 comprises a turret 16 which is mounted in a moon pool 18 that is formed in the hull 20 of the vessel 14. The turret 16 may be secured to a disconnectable buoy 22 which in turn is anchored to the sea floor using a number of mooring chains 24. In use, the buoy 22 is hoisted from a submerged position to the turret 16 using a pull-in rope 26 that is attached to a hoist 28, and the buoy is connected to the turret with a conventional structural collet connector 30.

The turret 16 is rotatably supported in the moon pool 18 by an upper bearing assembly 32 and, when the buoy 22 is attached to the turret, a lower bearing assembly 34. In this manner, the vessel 14 is allowed to weathervane around the turret 16 while still being firmly anchored to the sea floor. The upper bearing assembly 32 ideally comprises a combination thrust and radial bearing, such as a conventional three-row roller bearing, which supports the weight of the turret 16 and the mooring chains 24 and accommodates the horizontal and vertical mooring loads acting between the turret and the hull 20. The lower bearing assembly 34, in contrast, preferably comprises a radial bearing which accommodates only the horizontal loads acting between the buoy 22 and the hull 20. If desired, the turret mooring system 12 may also include a number of bumper pads 36, which may be comprised of, for example, rubber or polyethylene, to cushion the lower portion of the turret 16 from the hull 20 prior to connecting the buoy 22 to the turret.

Figure 2:
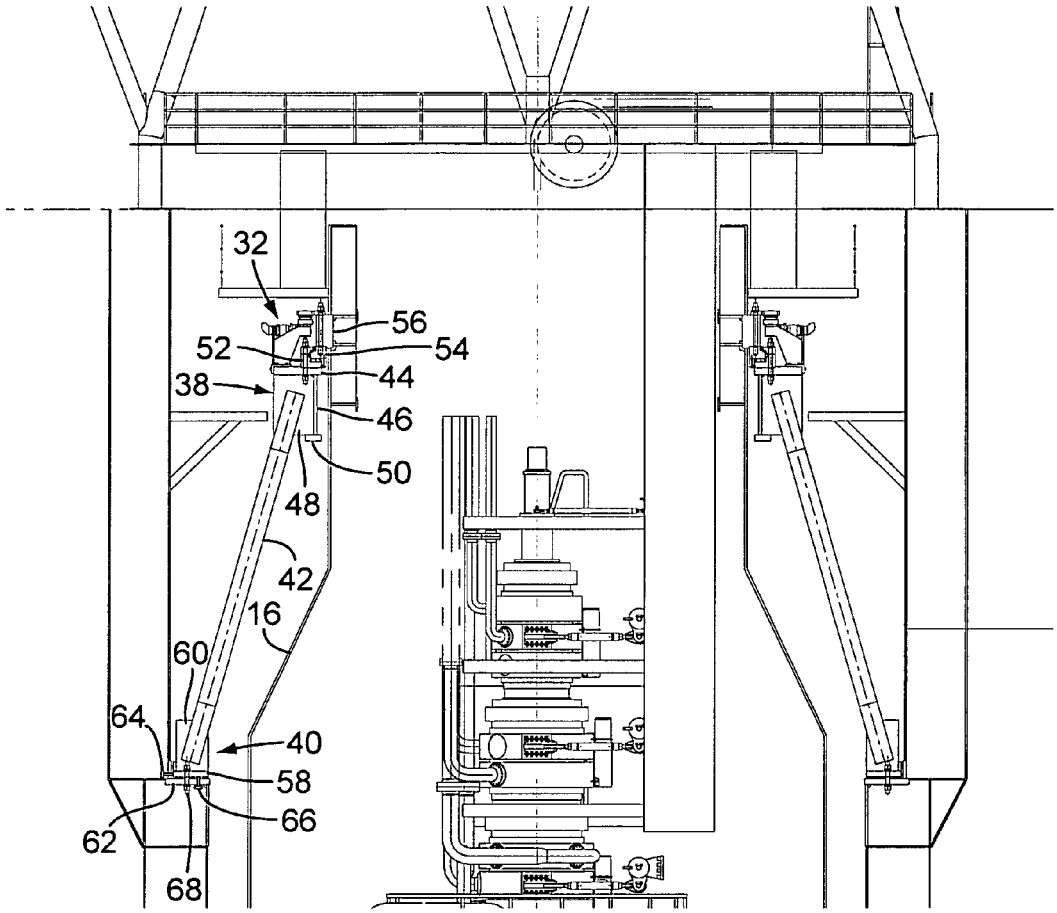
FIG. 2 is an enlarged cross sectional view of the upper bearing support assembly shown in FIG. 1.

In accordance with the present invention, the upper bearing assembly 32 is supported on the bearing support assembly 10. Referring to FIG. 2, the bearing support assembly 10 comprises an annular upper ring 38 to which the upper bearing assembly 32 is connected, an annular lower ring 40 which is connected to the hull 20, and a number of elongated support beams 42 which are each secured between the upper and lower rings. In a preferred embodiment of the invention, the bearing support assembly 10 is a pre-fabricated metal structure, that is, the upper ring 38, the lower ring 40 and the support beams 42 are all constructed of a suitable metal, such as carbon steel, and secured together such as by welding prior to being installed in the moon pool 18.

In the illustrated embodiment of the invention, the upper ring 38 is secured to the upper portion of the turret 16 and the support beams 42 are sufficiently long to allow the lower ring 40 to be secured to the hull 20 near the vertical center of the vessel 14. At this position, the deflections of the lower ring 40 caused by hogging and sagging of the vessel 14 will be significantly reduced compared with the deflections the lower ring would experience if it were secured to the hull 20 closer to the upper ring 38. As a result, the upper ring 38 will also experience reduced deflections, and the upper bearing assembly 32 will therefore remain generally circular. Thus, it may be seen that the bearing support assembly tends to isolate the upper bearing assembly 32 from the distortions of the moon pool 18 which are caused by hogging and sagging of the vessel 14.

The length, number and cross sectional configuration of the support beams 42 will depend on the size of the turret 16 and the anticipated vertical mooring loads that will be transmitted through the upper bearing assembly 32. In addition, the length and cross sectional configuration of the support beams 42 are selected so that they will deflect slightly to allow the turret 16 to pivot about a horizontal axis located near the upper bearing assembly 32 when the turret is subjected to horizontal mooring loads. In an exemplary embodiment of the invention, for example, the support beams 42 may each be constructed of twelve-inch diameter carbon steel tubing and have a length of approximately twenty feet, and a total of twenty four such support beams may be evenly distributed around the bearing support assembly 10.

Referring still to FIG. 2, the upper ring 38 preferably comprises a circular base 44 which is attached to the top of a cylindrical hoop 46. In addition, the upper end of each support beam 42 is ideally attached to an upper rib 48 which optimally is connected to both the base 44 and the hoop 46. The upper ring 38 may also comprise a stiffener ring 50, which is preferably attached to the bottom of the hoop 46 and each upper rib 48, to facilitate the assembly of and provide additional stiffness to the upper ring.

If as shown in FIG. 2 the upper bearing assembly 32 comprises a three-row roller bearing, a lower or outer race 52 of the bearing assembly may be bolted to the base 44 and an upper or inner race 54 of the bearing assembly may be attached to a conventional upper bearing ring 56 which is connected to or formed integrally with the upper end of the turret 16. Thus, the vertical and horizontal mooring loads which act on the turret 16 will be transmitted through the upper bearing assembly 32 to the upper ring 38, from the upper ring to the support beams 42, and from the support beams to the lower ring 40.

The lower ring 40 preferably comprises a circular reaction ring 58 and a number of lower ribs 60, each of which is secured to the reaction ring and to the lower end of a corresponding support beam 42. The reaction ring 58 is supported on a conventional moon pool support ring 62 which is attached to the moon pool 18 near the vertical center of the vessel 14. In addition, the bearing support assembly 10 ideally includes a number of radial and axial jack screws 64 and 66, respectively, which are operatively engaged between the hull 20 and/or the support ring 62 on the one hand and the reaction ring 58 on the other hand, to provide a means for aligning the axis of rotation of the upper bearing assembly 32 with the axis of rotation of the lower bearing assembly 34. Once the axes of rotation are properly aligned, the interface between the support ring 62 and the reaction ring 58 may be filled with grout and these two components secured together with, for example, a number of bolts 68 to prevent the separation of the bearing support assembly 10 from the moon pool 18 due to uplift of the turret 16.

In operation of the bearing support assembly 10, the vertical and horizontal mooring loads acting on the turret 16 are transmitted through the upper bearing assembly 32 to the upper ring 38. From the upper ring 38, the mooring loads are transmitted through the support beams 42 to the lower ring 40, and from the lower ring 40 to the hull 20 of the vessel 14. In addition, due to the clearance between the turret 16 and the lower bearing assembly 34, the horizontal mooring loads will cause the turret to pivot about a horizontal axis located near the upper bearing assembly 32. The resulting bending force will be transmitted through the upper bearing assembly 32 to the support beams 42, which will deflect slightly to allow the turret 16 to pivot.

Since the vessel 14 reacts somewhat like a beam in bending, the deflections of the normally circular shape of the moon pool 18 caused by hogging and sagging of the vessel 14 will be minimized near the vertical center of the hull 20. Thus, by mounting the lower ring 40 near the vertical center of the hull 20, the deflections of the lower ring due to hogging and sagging of the vessel 14 will also be minimized. As a result, the upper ring 38 and, thus, the upper bearing assembly 32 will remain relatively circular during operation. In addition, due to the particular construction of the support beams 42, they will deflect slightly to accommodate the pivoting of the turret 16 caused by the horizontal mooring loads and thereby prevent the upper bearing assembly 32 from becoming damaged. Therefore, the bearing support assembly 10 effectively isolates the upper bearing assembly 32 from both the deflections of the vessel 14 and the pivoting of the turret 16.

It should be recognized that, while the present invention has been described in relation to the preferred embodiments thereof, those skilled in the art may develop a wide variation of structural and operational details without departing from the principles of the invention. Therefore, the present application should be construed to cover all equivalents falling within the true scope and spirit of the invention.

What is claimed is:

1. A turret mooring system for a vessel which includes a moon pool, the turret mooring system comprising:

a turret which is positioned in the moon pool;

means for anchoring the turret to the sea floor;

an upper bearing assembly for rotatably connecting the turret to the vessel; and a bearing support assembly which comprises an upper ring member to which the upper bearing assembly is connected, a lower ring member which is connected to the vessel in the moon pool, and a number of elongated support beams which are connected between the upper and lower ring members;

wherein the lower ring member is connected to the vessel near the vertical center of the vessel; and wherein the upper ring member, the lower ring member and the support beams together comprise an integral assembly which is pre-fabricated prior to being installed in the moon pool.

2. The turret mooring system of claim 1, wherein the support beams are designed to deflect in order to allow the turret to pivot about a horizontal axis located near the upper bearing assembly.

3. The turret mooring system of claim 1, wherein the upper ring member comprises a circular base to which the upper bearing assembly is connected and a cylindrical hoop which is connected to the base.

4. The turret mooring system of claim 3, wherein the upper ring member further comprises a number of upper ribs, each of which is connected to the base, the hoop and an upper end of a corresponding support beam.

5. The turret mooring system of claim 1, wherein the lower ring member comprises a circular reaction ring which is supported on a corresponding portion of the vessel.

6. The turret mooring system of claim 5, wherein the lower ring member further comprises a number of lower ribs, each of which is connected to the reaction ring and a lower end of a corresponding support beam.

7. The turret mooring system of claim 5, wherein the reaction ring is supported on a support ring that is attached to the vessel.

8. The turret mooring system of claim 7, further comprising means for aligning the axis of rotation of the upper bearing assembly with another axis.

9. The turret mooring system of claim 8, wherein the aligning means comprises a number of axial jack screws which are operatively engaged between the support ring and the reaction ring.

10. The turret mooring system of claim 9, wherein the aligning means further comprises a number of radial jack screws which are operatively engaged between the vessel and the reaction ring.

11. The turret mooring system of claim 7, further comprising means for securing the reaction ring to the support ring.

12. The turret mooring system of claim 11, wherein the securing means comprises a number of bolts.

13. The turret mooring system of claim 7, further comprising a hardenable grout which is disposed between the support ring and the reaction ring.

14. A bearing support assembly for a turret mooring system which includes a turret that is positioned in a moon pool of a vessel and is rotatably connected to the vessel by an upper bearing assembly, the bearing support assembly comprising:

an upper ring member to which the upper bearing assembly is connected;

a lower ring member which is connected to the vessel in the moon pool; and a number of elongated support beams which are connected between the upper and lower ring members;

wherein the lower ring member is located closer to the vertical center of the vessel than to the top of the moon pool; and wherein the upper ring member, the lower ring member and the support beams together comprise an integral assembly which is pre-fabricated prior to being installed in the moon pool.

15. The turret mooring system of claim 14, wherein the lower ring member is connected to the vessel near the vertical center of the vessel.

16. The turret mooring system of claim 14, wherein the support beams are designed to deflect in order to allow the turret to pivot about a horizontal axis located near the upper bearing assembly.

17. The turret mooring system of claim 14, wherein the upper ring member comprises a circular base to which the upper bearing assembly is connected and a cylindrical hoop which is connected to the base.

18. The turret mooring system of claim 17, wherein the upper ring member further comprises a number of upper ribs, each of which is connected to the base, the hoop and an upper end of a corresponding support beam.

19. The turret mooring system of claim 14, wherein the lower ring member comprises a circular reaction ring which is supported on a corresponding portion of the vessel.

20. The turret mooring system of claim 19, wherein the lower ring member further comprises a number of lower ribs, each of which is connected to the reaction ring and a lower end of a corresponding support beam.

21. The turret mooring system of claim 19, wherein the reaction ring is supported on a support ring that is attached to the vessel.

22. The turret mooring system of claim 21, further comprising means for aligning the axis of rotation of the upper bearing assembly with another axis.

23. The turret mooring system of claim 22, wherein the aligning means comprises a number of axial jack screws which are operatively engaged between the support ring and the reaction ring.

24. The turret mooring system of claim 23, wherein the aligning means further comprises a number of radial jack screws which are operatively engaged between the vessel and the reaction ring.

25. The turret mooring system of claim 21, further comprising means for securing the reaction ring to the support ring.

26. The turret mooring system of claim 25, wherein the securing means comprises a number of bolts.

27. A turret mooring system for a vessel which includes a moon pool, the turret mooring system comprising:

a turret which is positioned in the moon pool;

means for anchoring the turret to the sea floor;

an upper bearing assembly for rotatably connecting the turret to the vessel; and a bearing support assembly which comprises an upper ring member to which the upper bearing assembly is connected, a lower ring member, and a number of elongated support beams which are connected between the upper and lower ring members;

wherein the lower ring member is secured to a support ring which is attached to the moon pool near the vertical center of the vessel.

28. The turret mooring system of claim 27, wherein the lower ring member comprises a circular reaction ring which is supported on the support ring.

29. The turret mooring system of claim 28, further comprising means for aligning the axis of rotation of the upper bearing assembly with another axis.

30. The turret mooring system of claim 29, wherein the aligning means comprises a number of axial jack screws which are operatively engaged between the support ring and the reaction ring.

31. The turret mooring system of claim 30, wherein the aligning means further comprises a number of radial jack screws which are operatively engaged between the vessel and the reaction ring.

32. The turret mooring system of claim 28, further comprising means for securing the reaction ring to the support ring.

33. The turret mooring system of claim 32, wherein the securing means comprises a number of bolts.

34. The turret mooring system of claim 28, further comprising a hardenable grout which is disposed between the support ring and the reaction ring.

* * * * *